US008534242B2

(12) United States Patent
Busse

(10) Patent No.: US 8,534,242 B2
(45) Date of Patent: Sep. 17, 2013

(54) DEVICE FOR VARIABLY ADJUSTING THE TIMING CONTROL OF GAS EXCHANGE VALVES OF AN INTERNAL COMBUSTION ENGINE

(75) Inventor: Michael Busse, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 528 days.

(21) Appl. No.: 12/821,455

(22) Filed: Jun. 23, 2010

(65) Prior Publication Data

US 2010/0326385 A1 Dec. 30, 2010

(30) Foreign Application Priority Data

Jun. 24, 2009 (DE) ..... 10 2009 030 201

(51) Int. Cl.
*F01L 9/02* (2006.01)

(52) U.S. Cl.
USPC ..... 123/90.12; 123/90.13; 123/90.15; 464/160

(58) Field of Classification Search
USPC ..... 123/90.15, 90.17, 90.12, 90.13; 464/160
See application file for complete search history.

(56) References Cited

U.S. PATENT DOCUMENTS

| | | | | |
|---|---|---|---|---|
| 5,247,914 | A * | 9/1993 | Imai et al. | 123/90.17 |
| 5,704,317 | A | 1/1998 | Barth | |
| 7,762,221 | B2 * | 7/2010 | Kira | 123/90.17 |

FOREIGN PATENT DOCUMENTS

| | | |
|---|---|---|
| DE | 42 18 082 | 12/1993 |
| DE | 101 50 856 | 4/2003 |
| DE | 10 2007 056 684 | 5/2009 |
| EP | 0 806 550 | 11/1997 |

* cited by examiner

*Primary Examiner* — Ching Chang
(74) *Attorney, Agent, or Firm* — Lucas & Mercanti, LLP

(57) ABSTRACT

A device for variably adjusting the timing control of gas exchange valves of an internal combustion engine. The device has a hydraulic phase adjustment device, a control valve and an auxiliary pressure source. The phase adjustment device can be brought into driving connection with a crankshaft and a camshaft, the phase adjustment device has at least two counter-working pressure chambers, and a phase relation of the camshaft relative to the crankshaft is variably adjustable by charging of the pressure chambers with pressure medium. The control valve has at least one inflow port and a first and a second working port. The inflow port is connectable to a pressure medium pump, and the first working port is connectable to the first pressure chamber and the second working port to the second pressure chamber.

10 Claims, 4 Drawing Sheets

DEVICE FOR VARIABLY ADJUSTING THE TIMING CONTROL OF GAS EXCHANGE VALVES OF AN INTERNAL COMBUSTION ENGINE

This application claims the priority of DE 10 2009 030 201.8 filed Jun. 24, 2009, the priority of both applications is hereby claimed and both applications are incorporated by reference herein.

FIELD OF THE INVENTION

The invention relates to a device for variably adjusting the timing control of gas exchange valves of an internal combustion engine, comprising a hydraulic phase adjustment device, a control valve and an auxiliary pressure source, it being possible to bring the phase adjustment device into driving connection to a crankshaft and a camshaft, the phase adjustment device including at least two counter-working pressure chambers and a phase relation of the camshaft relative to the crankshaft being variably adjustable by charging of the pressure chambers with pressure medium, the control valve having at least one inflow port and a first and a second working port, the inflow port being connectable to a pressure medium pump, and the first working port being connectable to the first pressure chamber and the second working port to the second pressure chamber.

BACKGROUND OF THE INVENTION

In modern internal combustion engines, devices for variably adjusting the timing control of gas exchange valves are used in order to configure the phase relation between a crankshaft and a camshaft variably between a maximum advance and a maximum retard position, within a defined angular range. The device comprises a hydraulic phase adjustment device and a control valve. The phase adjustment device comprises a drive element, an output element and at least one pair of counter-working pressure chambers. The drive element is in driving connection to the crankshaft, for example by means of a traction drive or gear drive. The output element is in driving connection to the camshaft, which connection usually is effected by a non-rotatable attachment of the output element to the camshaft. By means of appropriate charging of the pressure chambers with pressure medium and discharging thereof, the phase relation of the output element relative to the drive element (and therefore of the camshaft relative to the crankshaft) can be adjusted variably within a defined angular interval. Phase adjustment devices of this type are embodied, for example, as vane cell adjusters or axial piston adjusters, which are known from DE 101 50 856 A1 and DE 42 18 082 A1 and to the disclosed content of which reference is made herewith.

The flows of pressure medium from and to the pressure chambers are regulated by means of the control valve. The control valve generally comprises a hollow-cylindrical valve housing on which are embodied an inflow port, an outflow port and two working ports. The inflow port is connected to a pressure medium pump of the internal combustion engine and the outflow port to a tank. Each of the working ports communicates with one of the pressure chambers.

The control valve, generally in the form of a proportional control valve, has a control piston arranged to be axially displaceable within the valve housing, by means of which control piston the working ports can be connected selectively to the inflow port or the outflow port. Thus, pressure medium can be supplied to the first pressure chamber while at the same time pressure medium can be discharged to the tank from the second pressure chamber, or vice versa. The flows of pressure medium from and to the phase adjustment device can therefore be regulated by means of the control valve.

The pressure medium is usually made available by a pressure medium pump of the internal combustion engine. Under unfavorable operating conditions, for example at low rotational speeds of the internal combustion engine with high pressure medium temperatures, the volume flow delivered by the pressure medium pump, or the operating pressure resulting therefrom, may be insufficient to execute the phase adjustment specified by an engine control device at the desired speed. Furthermore, during the switch-off process of the internal combustion engine, the operating pressure may be insufficient to set the phase relation to a base position in which unproblematic restarting of the internal combustion engine is possible. To eliminate these problems, it is known to provide auxiliary pressure sources, for example pressure accumulators, which make available an additional volume of pressure medium in order to make possible the desired adjustment in case of an insufficient quantity of pressure medium delivered by the pump.

A device of this type is known, for example, from EP 0 806 550 A1. In this embodiment, a pressure accumulator is provided as the auxiliary pressure source and communicates with a pressure medium line which connects the pressure medium pump to the inflow port of the control valve. A disadvantage of this embodiment is that the pressure within the pressure accumulator corresponds to the operating pressure delivered by the pressure medium pump at all times. The volume stored in the pressure accumulator therefore decreases when the operating pressure falls. Pressure medium is therefore already supplied from the pressure accumulator to the pressure medium system of the internal combustion engine when the operating pressure is falling but has not yet fallen below the critical value. In the critical operating phases of the internal combustion engine, therefore, the total volume of pressure medium which can be stored in the pressure accumulator is not available in the phase adjustment device.

A further device is known from U.S. Pat. No. 5,704,317 A. In this embodiment the pressure accumulator also communicates with a pressure medium line which connects the pressure medium pump to the control valve. To prevent a premature outflow of pressure medium from the pressure accumulator, a directional control valve which, in a first control position, allows filling of the pressure accumulator, is arranged between the pressure medium line and the pressure accumulator. In a second control position, the pressure accumulator is connected to the inflow port of the control valve. A disadvantage of this embodiment is the large space requirement entailed by the two separate control valves.

OBJECT OF THE INVENTION

It is the object of the invention to provide a device for variably adjusting the timing control of gas exchange valves of an internal combustion engine whereby the space requirement and cost of the device are to be reduced.

The object is achieved according to the invention in that the control valve has a secondary inflow port which is connectable to the auxiliary pressure source.

The device comprises at least one hydraulic phase adjustment device, a control valve and an auxiliary pressure source. The phase adjustment device may be in the form, for example, of a vane cell adjuster or an axial piston adjuster, and includes at least one drive element and an output element. In the installed state of the device, the drive element is in driving connection to the crankshaft via a gear drive or a traction drive, for example a belt or chain drive. The output element is arranged to be swivelable relative to the drive element within a defined angular range and is in driving connection to the camshaft. For this purpose it may, for example, be fastened non-rotatably to the camshaft.

Provided within the device is at least one pair of counter-working pressure chambers, by pressurization of which the output element can be swiveled relative to the drive element, and therefore the camshaft relative to the crankshaft. A plurality of pairs of counter-working pressure chambers are advantageously provided.

To regulate the flows of pressure medium from and to the phase adjustment device, there is provided a control valve which has a plurality of ports, for example an inflow port, an outflow port and two working ports. The inflow port communicates with a pressure medium pump of the internal combustion engine. The outflow port communicates with a tank. Each of the working ports communicates with a pressure chamber or a group of counter-working pressure chambers. The control valve has an actuating unit which sets various control positions of the control valve in accordance with control commands of the engine control device. The working ports can therefore be connected selectively to the inflow port and the outflow port, and pressure medium conveyed by the pressure medium pump can thus be supplied to a group of pressure chambers while pressure medium is discharged to the tank from the other pressure chambers.

In addition, a secondary inflow port, which is connected to the auxiliary pressure source, is provided on the control valve. Pressure medium, which reaches the control valve from the secondary auxiliary source, can therefore be transmitted by the control valve, and an additional pressure medium supply from the auxiliary pressure source to the pressure chambers can therefore be controlled. In this case, the pressure medium volume conveyed from the auxiliary pressure source to the secondary inflow port may be conducted directly to one of the working ports, for example. Alternatively, a control volume of the auxiliary pressure source, for example of a pressure accumulator, may, for example, be directed to the tank port, whereby a storage volume of the pressure accumulator is released. This storage volume may thereby be supplied to a pressure medium line running between the pressure medium pump and the phase adjustment device.

In all cases, an additional volume flow passes via the secondary inflow port and the control valve. The pressure medium flow from the pressure medium pump to the phase adjustment device, and the connecting of an auxiliary pressure source, for example a pressure accumulator or an electrically driven pressure medium pump, can therefore be controlled by means of a single control valve. The space requirement and cost of the device are therefore considerably reduced, since only one actuating unit, which is usually in the form of electromagnetic actuating unit, is required.

In a concrete embodiment of the invention, it is proposed that the control valve can be moved to a first control position in which both the pressure medium pump and the auxiliary pressure source are connected to the first pressure chamber, and that the control valve can be moved to a second control position in which the pressure medium pump is connected to the first pressure chamber and a pressure medium volume flow from the auxiliary pressure source to the phase adjustment device is blocked.

In addition, it may be provided that the control valve can be moved to a third control position in which a pressure medium volume flow to both pressure chambers is blocked or is equal and a pressure medium volume flow from the auxiliary pressure source to the phase adjustment device is blocked; that the control valve can be moved to a fourth control position in which the pressure medium pump is connected to the second pressure chamber and a pressure medium volume flow from the auxiliary pressure source to the phase adjustment device is blocked; and that the control valve can be moved to a fifth control position in which both the pressure medium pump and the auxiliary pressure source are connected to the second pressure chamber.

The control valve is configured in such a manner that it has at least one control position in which only pressure medium conveyed by the pressure medium pump is directed to one of the working ports, and therefore to one of the two pressure chambers or groups of pressure chambers. In this control position, as a result of the configuration of the control valve, pressure medium is prevented from being directed from the auxiliary pressure source to the phase adjustment device. If the auxiliary pressure source is in the form of a pressure accumulator, pressure medium is advantageously prevented from being directed from the pressure accumulator through the control valve. This can be achieved, for example, by blocking the secondary inflow port by means of a control piston. Furthermore, there is provided a further control position in which both the pressure medium pump and the auxiliary pressure source are connected to the first pressure chamber. The auxiliary pressure source thus supports the phase adjustment process.

During operation of the internal combustion engine, a plurality of torques usually act on the output element. These are, for example, alternating torques produced by the cams running on cam followers. In addition, a braking moment produced by friction of the camshaft in its bearings or between cams and cam followers acts on the output element. Furthermore, spring elements, which urge the output element in a direction of rotation relative to the drive element, may be provided. As a rule, these torques result in a torque which urges the phase relation of the output element relative to the drive element in the direction of advanced or retarded timing control. In the first control position the auxiliary pressure source is advantageously connected to the pressure chamber (s) which work(s) against the resulting torque.

In addition, there may be provided two further control positions which correspond to the first two control positions with the difference that pressure medium reaches the other working port, and therefore the other pressure chamber or group of pressure chambers. In this case, there is provided between these groups of control positions a neutral position of the control valve, by adoption of which the phase relation is maintained constant. In this control position the pressure medium flow to both working ports is blocked. Alternatively, in the neutral position small, substantially equal flows of pressure medium from the pressure medium pump to both working ports may be allowed, in order to compensate for leakage from the phase adjustment device. In the neutral position, a pressure medium flow from the auxiliary pressure source to the phase adjustment device is blocked.

In operating phases in which the pressure medium supply is ensured by the pressure medium pump, therefore, the second and—if these are embodied on the control valve—the third and fourth control positions can be used to regulate the phase adjustment device. Only one pressure medium flow from the pressure medium pump to the phase adjustment device is therefore allowed, and a volume flow from the auxiliary pressure source is blocked. In the case of a pressure accumulator, therefore, discharging thereof is prevented in operating phases in which no additional pressure medium flow is required. The pressure accumulator remains completely filled and its total volume is available in operating phases of the internal combustion engine in which reliable operation of the phase adjustment device is not ensured by the pressure medium pump alone.

The auxiliary pressure source can be connected by setting of the first or, if present, the fifth control position of the control valve.

In a concrete embodiment of the invention, it is provided that the auxiliary pressure source is in the form of a pressure accumulator with a storage chamber, and the secondary inflow port is connected to the storage chamber of the pressure accumulator. During operation of the internal combustion engine, the pressure accumulator is filled with pressure medium. This is advantageously effected directly by the pressure medium pump, without a hydraulic valve being interposed. In this case a backflow of pressure medium can be prevented in known fashion, for example by a nonreturn valve arranged between the pressure medium pump and the pressure accumulator.

In addition, it may be provided that, in the first or fifth control position, the secondary inflow port communicates with one of the working ports. Thus, by setting the corresponding control positions, the storage chamber of the pressure accumulator can be discharged into the corresponding pressure chambers by means of the control valve, and can therefore support the phase adjustment process. In this case it may be provided that the control valve has a hollow valve housing and a hollow control piston arranged therein, which control piston is displaceable between two end positions, and both the inflow port and the secondary inflow port and one of the working ports communicate with the interior of the control piston in the first or fifth control position. The flows of pressure medium from both the pressure medium pump and the auxiliary pressure source can therefore be conducted to the corresponding working port via the interior of the control piston, whereby the structure of the control valve for realizing the desired switching logic is considerably simplified. Through appropriate design of the control valve it is also possible in this case to implement a switching logic by means of only one secondary inflow port, thus minimizing the space requirement of the hydraulic section of the control valve.

In a further configuration, in may be provided that the auxiliary pressure source is in the form of a pressure accumulator with a storage chamber and a control chamber, and the secondary inflow port is connected to the control chamber of the pressure accumulator and the inflow port is additionally connected to the storage chamber.

Furthermore, it may be provided that the secondary inflow port communicates with an outflow port embodied on the control valve in the first or fifth control position.

In this embodiment, a pressure accumulator with pressure intensifier is used. A pressure accumulator of this type is described, for example, in DE 10 2007 056 684 A1. The pressure accumulator comprises a storage chamber and a control chamber which are separated from one another hydraulically and are delimited by a common piston. By charging the control chamber and the storage chamber with pressure medium, the piston is displaced against the force of a spring, whereby the pressure accumulator is filled. In this case the control chamber is decoupled from the pressure medium fluctuations in the hydraulic system. Discharging of the control chamber can be controlled by means of a hydraulic valve. The storage chamber is connected to a pressure medium line which connects the pressure medium pump to the control valve. When the pressure in the pressure medium circuit of the internal combustion engine drops, the pressure medium in the control chamber prevents the piston from forcing the pressure medium out of the storage chamber as a result of the spring force. The pressure medium of the storage chamber is released in that the hydraulic valve allows the control chamber to be discharged. In this case, the discharging of the control chamber can be effected via the control valve, which regulates the pressure medium flows to and from the phase adjustment device. Only one control valve is therefore needed to control the pressure medium flow from the pressure medium pump and from the pressure accumulator to the phase adjustment device.

BRIEF DESCRIPTION OF THE DRAWINGS

Further features of the invention are apparent from the following description and from the drawings, in which exemplary embodiments of the invention are represented in simplified form and in which.

DETAILED DESCRIPTION OF THE DRAWINGS

Figure 1:
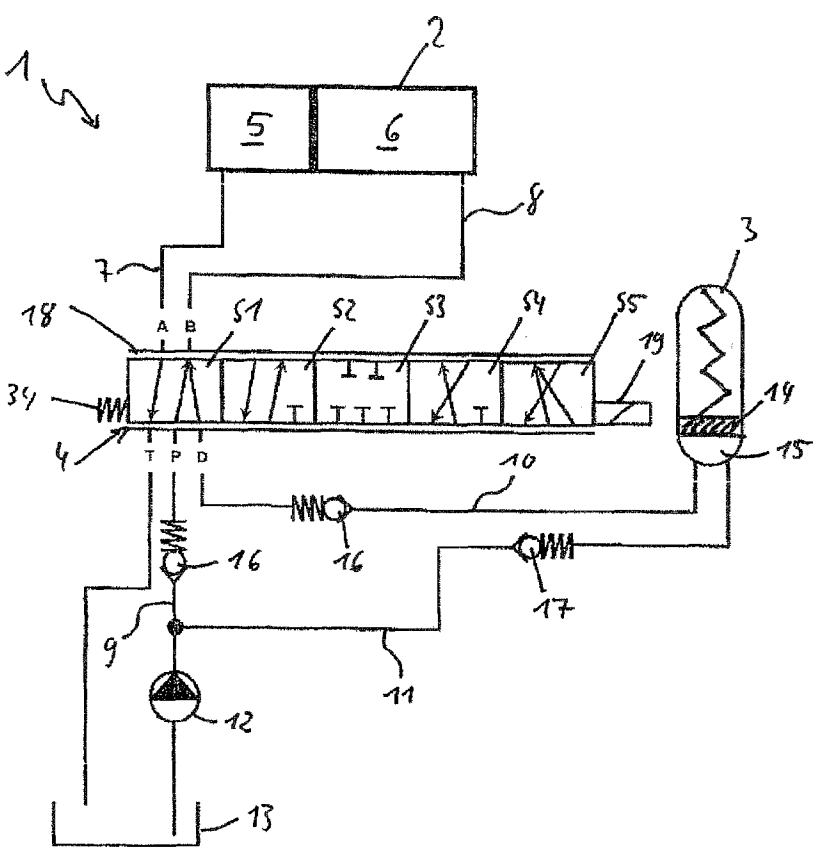
FIG. 1 is a schematic representation of a first embodiment of a device according to the invention.

FIG. 1 shows a first embodiment of a device 1 according to the invention in a schematic representation. The device 11 comprises a phase adjustment device 2 which is known, for example, from DE 101 50 856 A1 or DE 42 18 082 A1, an auxiliary pressure source 3, which, in the embodiment shown, is in the form of a pressure accumulator 3, and a control valve 4. In FIG. 1, only two counter-working pressure chambers 5, 6 of the phase adjustment device 2 are shown; regarding the details of the phase adjustment device 2, reference is made to the above-mentioned documents.

The control valve 4 has an inflow port P, an outflow port T, two working ports A, B and a secondary inflow port D. The first working port A communicates via a first pressure medium line 7 with the first pressure chamber 5. The second working port B communicates via a second pressure medium line 8 with the second pressure chamber 6. The inflow port P communicates via a third pressure medium line 9 with a pressure medium pump 12 of the internal combustion engine. The outflow port T communicates with a tank 13. The pressure accumulator 3 has a storage chamber 15 delimited by a spring-loaded piston 14, which storage chamber 15 communicates via a fourth pressure medium line 10 with the secondary inflow port D and via a fifth pressure medium line 11 with the third pressure medium line 9.

Nonreturn valves 16, which prevent pressure spikes generated in the phase adjustment device 2 from being propagated to the pressure medium pump 12 and the storage chamber 15, are arranged in the third and fourth pressure medium lines 9, 10, respectively, between the pressure medium pump 12 and the control valve 4, and between the storage chamber 15 and the control valve 4. In addition, a further nonreturn valve 17 is provided in the fifth pressure medium line 11 between the pressure medium pump 12 and the storage chamber 15. During operation of the internal combustion engine, the storage chamber 15 of the pressure accumulator 3 is filled by the pressure medium pump 12 via the fifth pressure medium line 11. When the operating pressure falls, the non-return valve 17 prevents the pressure medium stored in the storage chamber 15 from flowing back into the third pressure medium line 9. The pressure accumulator 3 therefore retains its filling level even when the operating pressure falls.

The control valve 4 consists of a hydraulic section 18 and an actuating unit 19. By means of the actuating unit 19 the control valve 4 can be moved into five control positions S1-S5.

In the first control position S1, the first working port A is connected to the outflow port T, and both the inflow port P and the secondary inflow port D are connected to the second working port B. Pressure medium therefore reaches the tank 13 from the first pressure chamber 5. At the same time pressure medium from the pressure medium pump 12 and from the storage chamber 15 of the pressure accumulator 3 can be supplied to the second pressure chamber 6. The camshaft is therefore adjusted relative to the crankshaft in the direction of advanced timing.

In the second control position S2, the first working port A continues to be connected to the outflow port T and the inflow port P to the second working port B. Pressure medium therefore reaches the tank 13 from the first pressure chamber 5. At the same time, pressure medium is supplied by the pressure medium pump 12 to the second pressure chamber 6. In this control position S2 the secondary inflow port D is blocked, whereby discharging of the storage chamber 15 of the pressure accumulator 3 is prevented. The camshaft is therefore adjusted relative to the crankshaft in the direction of advanced timing, and discharging of the storage chamber 15 is prevented.

In the third control position S3, neither of the working ports A, B communicates with the inflow port P or with the outflow port T. At the same time, the secondary inflow port D is blocked. Discharging of the storage chamber 15 of the pressure accumulator 3 is therefore prevented and the phase relation of the camshaft relative to the crankshaft is maintained constant. Alternatively, a throttled pressure medium flow may be permitted from the inflow port P to both working ports A, B, in order to compensate for leakage from the phase adjustment device 2.

In the fourth control position S4, the second working port B is connected to the outflow port T and the inflow port P is connected to the first working port A. Pressure medium therefore reaches the tank 13 from the second pressure chamber 6. At the same time, pressure medium is supplied to the first pressure chamber 5 by the pressure medium pump 12. In this control position S4 the secondary inflow port D is blocked, whereby discharging of the storage chamber 15 of the pressure accumulator 3 is prevented. The camshaft is therefore adjusted relative to the crankshaft in the direction of retarded timing.

In the fifth control position S5, the second working port B continues to be connected to the outflow port T, and both the inflow port P and the secondary inflow port D are connected to the first working port A. Pressure medium therefore reaches the tank 13 from the second pressure chamber 6. At the same time, pressure medium can be supplied to the first pressure chamber 5 by the pressure medium pump 12 and the storage chamber 15 of the pressure accumulator 3. The camshaft is therefore adjusted relative to the crankshaft in the direction of retarded timing.

The control positions S2 to S4 correspond to the control positions of a 4/3-way proportional valve, which is generally used to regulate the phase adjustment device 2 and is known, for example, from DE 101 50 856 A1. In the operating phases of the internal combustion engine in which the pressure medium volume flow delivered by the pressure medium pump 12 is sufficient to operate the phase adjustment device 2 reliably, only these control positions S2 and S4 are set. Only the volume flow delivered by the pressure medium pump 12 is therefore used to adjust or maintain the relative phase position between camshaft and crankshaft. The pressure medium volume stored in the storage chamber 15 of the pressure accumulator 3 is either maintained constant or is increased via the fifth pressure medium line 11.

When the required volume of pressure medium exceeds the volume of pressure medium delivered by the pressure medium pump 12, the control positions S1 and S5 are used. In this case, the phase adjustment is supported by the pressure medium volume stored in the storage chamber 15 of the pressure accumulator 3.

FIGS. 2 to 6 show in longitudinal section the hydraulic section 18 of a control valve 4 which may be used in the inventive device 1. The hydraulic section 18 consists of a substantially hollow-cylindrical valve housing 20 and a control piston 21, which is arranged inside the valve housing 20 and is axially displaceable between two end positions.

The inflow port P, the secondary inflow port D, the working ports A, B and an outflow port T are formed on the lateral surface of the valve housing 20, in the form of radial housing openings 22-26 formed in annular grooves. Pressure medium can be exchanged between the pressure medium lines 7-10 and the interior of the valve housing 20 via the housing openings 22-26. An axial outflow port T is provided in addition to the radial pressure medium ports A, B, D, P, T.

The control piston 21 is also configured to be substantially hollow-cylindrical. A plurality of annular grooves 27-30 are formed on the outer lateral surface thereof, there being provided in the bases of the first, second and fourth annular grooves 27, 28, 30 piston openings 31-33 which connect the exterior of the control piston 21 to the interior thereof, in which interior an additional nonreturn valve is arranged in the embodiment illustrated.

Figure 2:
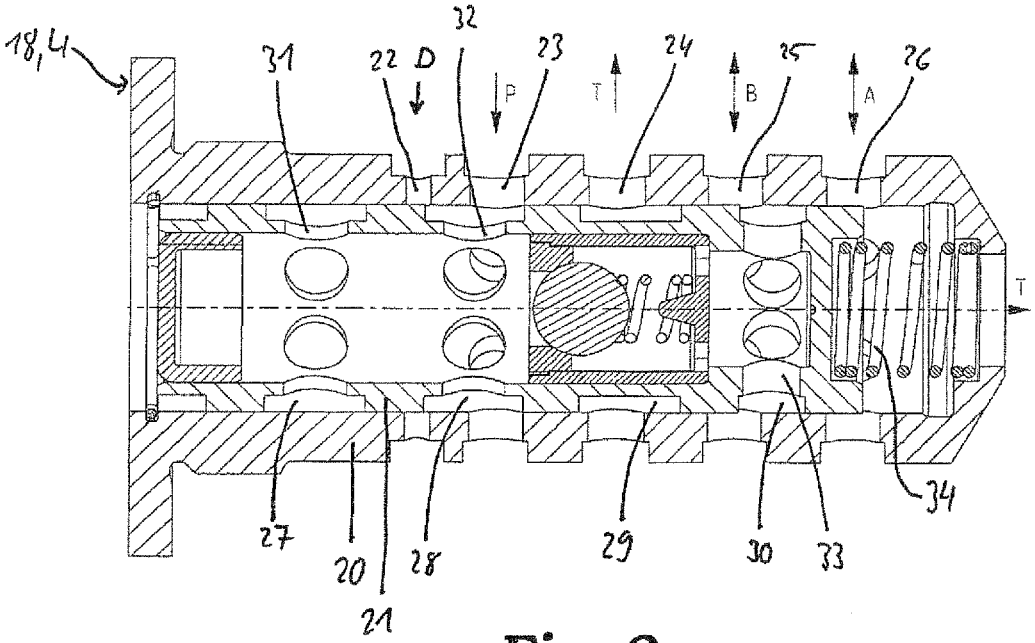
FIG. 2 shows a longitudinal section through a control valve of the device from FIG. 1 in a first control position.

In FIG. 2 the control valve 4 is shown in the first control position S1. In this control position S1, pressure medium from the pressure accumulator 3 can reach the second working port B, and therefore the second pressure chamber 6, via the secondary inflow port D, the first housing openings 22, the second annular groove 28, the second piston openings 32, the interior of the control piston 21, the third piston openings 33 and the fourth annular groove 30. In addition, the pressure medium pump 12 is also connected to the second working port B, and therefore to the second pressure chambers 6, via the inflow port P, the second housing openings 23, the second annular groove 28, the second piston openings 32, the interior of the control piston 21, the third piston openings 33 and the fourth annular groove 30. At the same time, the first working port A is connected directly to the axial outflow port T. Pressure medium from the pressure accumulator 3 and/or the pressure medium pump 12 can therefore reach the second pressure chambers 6, pressure medium being discharged from the first pressure chambers 5 at the same time. The phase relation of the phase adjustment device 2 is therefore adjusted in the direction of advanced timing.

Figure 3:
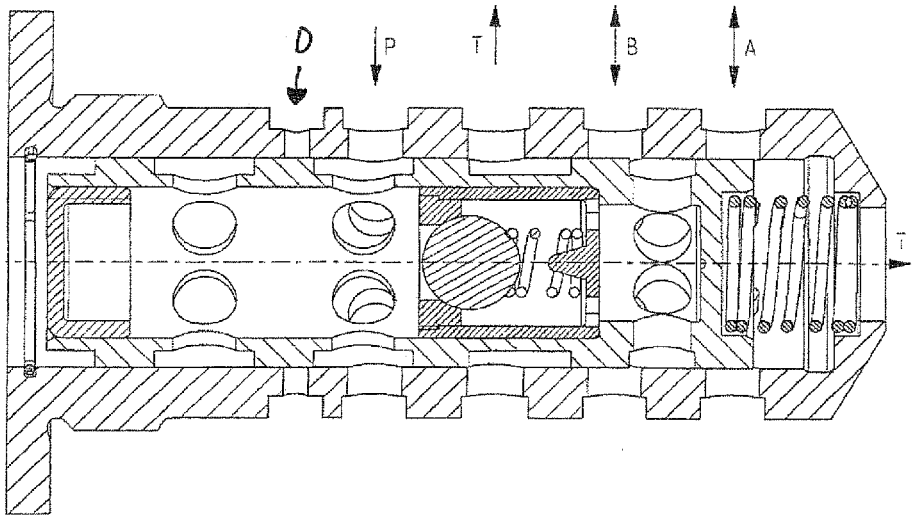
FIG. 3 shows a longitudinal section through the control valve analogously to FIG. 2 in a second control position.

By an axial displacement of the control piston 21 in the axial direction against a spring element 34, the second control position S2 shown in FIG. 3 is first reached. This second control position S2 differs from the first control position S1 in that the secondary inflow port D is blocked by the control piston 21, whereby discharging of the storage chamber 15 of the pressure accumulator 3 is prevented. In this control position S2, pressure medium from the pressure medium pump 12 can reach the second pressure chambers 6, pressure medium being discharged from the first pressure chambers 5 at the same time. The phase relation of the phase adjustment device 2 is therefore adjusted in the direction of advanced timing.

Figure 4:
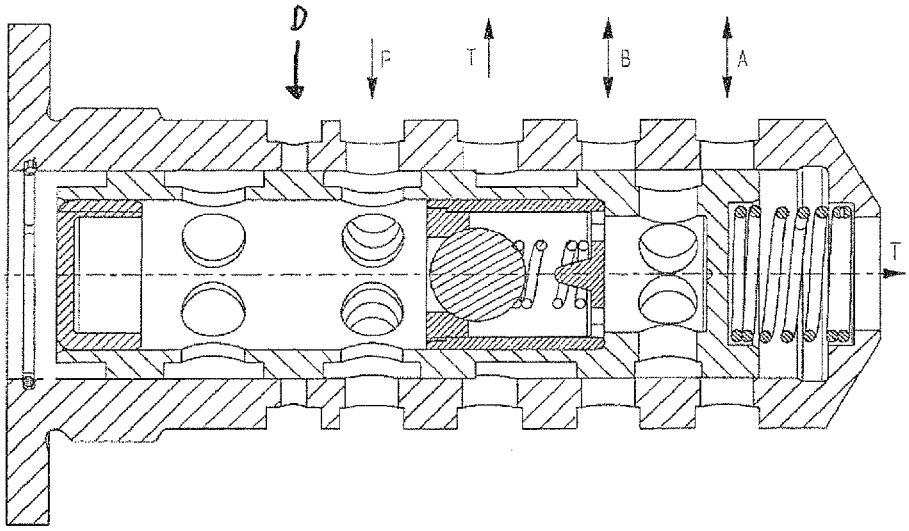
FIG. 4 shows a longitudinal section through the control valve analogously to FIG. 2 in a third control position.

By a further axial displacement of the control piston 21 in the axial direction against the spring element 34, the third control position S3, shown in FIG. 4 is reached. In this control position S3 both working ports A, B and the secondary inflow port D are blocked by the control piston 21. Pressure medium can therefore neither be supplied to the pressure chambers 5, 6 of the phase adjustment device 2, nor can pressure medium be discharged therefrom. The phase relation of the phase adjustment device 2 is therefore maintained constant. In addition, discharging of the storage chamber 15 of the pressure accumulator 3 is prevented.

Figure 5:
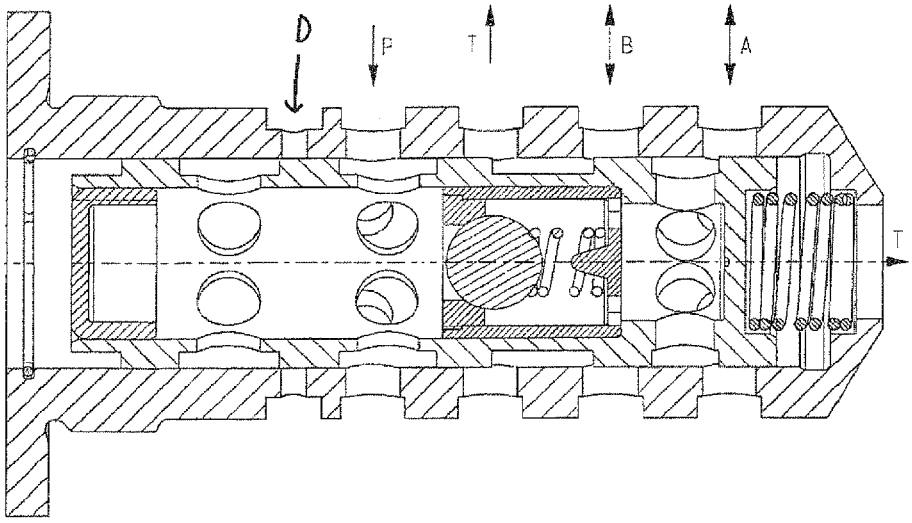
FIG. 5 shows a longitudinal section through the control valve analogously to FIG. 2 in a fourth control position.

By a further displacement of the control piston 21 in the axial direction, the control valve 4 adopts the fourth control position S4 shown in FIG. 5. In this control position S4 the pressure medium pump 12 is connected to the first working port A, and therefore to the first pressure chambers 5, via the inflow port P, the second housing openings 23, the second annular groove 28, the second piston openings 32, the interior of the control piston 21, the third piston openings 33 and the fourth annular groove 30. At the same time, the second working port B is connected to the radial outflow port T via the third annular groove 29. Pressure medium from the pressure medium pump 12 can therefore reach the first pressure chambers 5, pressure medium being discharged from the second pressure chambers 6 at the same time. The phase relation of the phase adjustment device 2 is therefore adjusted in the direction of retarded timing. At the same time, the secondary inflow port is blocked by the control piston 21, whereby discharging of the storage chamber 15 of the pressure accumulator 3 is prevented.

Figure 6:
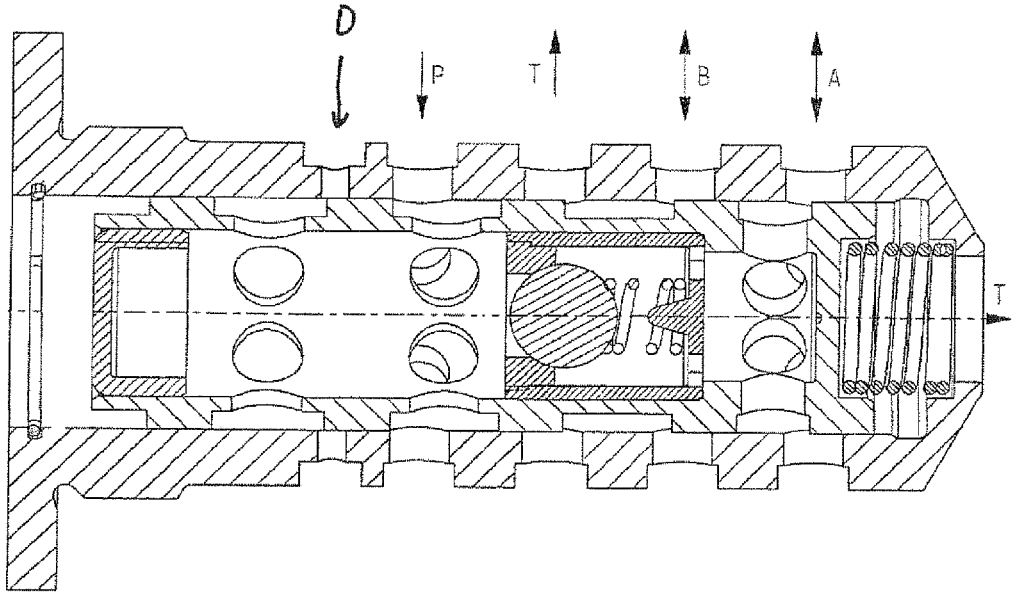
FIG. 6 shows a longitudinal section through the control valve analogously to FIG. 2 in a fifth control position.

By a further axial displacement of the control piston 21 in the axial direction against the spring element 34, the fifth control position S5 shown in FIG. 6 is reached. This differs from the fourth control position S4 in that the secondary inflow port D can reach the first working port A, and therefore the first pressure chamber 5, via the first housing openings 22, the first annular groove 27, the first piston openings 31, the interior of the control piston 21, the third piston openings 33 and the fourth annular groove 30. Pressure medium from the pressure accumulator 3 and/or from the pressure medium pump 12 can therefore reach the first pressure chambers 5, pressure medium being discharged from the second pressure chambers 6 at the same time. The phase relation of the phase adjustment device 2 is therefore adjusted in the direction of retarded timing.

Figure 7:
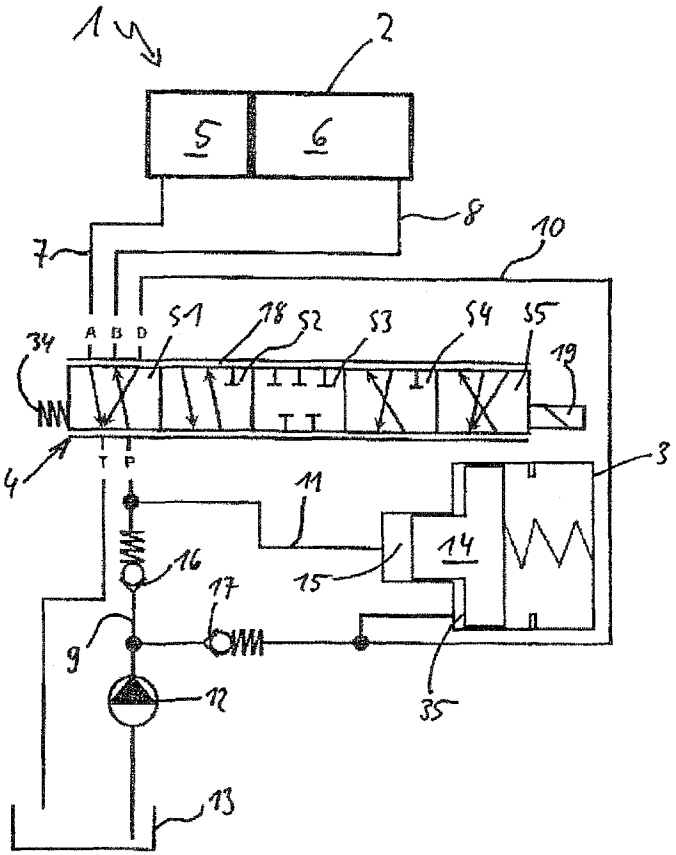
FIG. 7 is a schematic representation of a second embodiment of a device according to the invention.

FIG. 7 shows a second embodiment of a device 1 according to the invention in a schematic representation. In this embodiment, firstly, a modified pressure accumulator 3 is used. In addition, this embodiment differs from the device 1 shown in FIG. 1 by the switching logic of the control valve 4. In this embodiment, a pressure accumulator 3 with pressure intensifier is used. In addition to a storage chamber 15, the piston 14 of this pressure accumulator 3 also delimits a control chamber 35, the control chamber 35 being separated hydraulically from the storage chamber 15.

The fourth pressure medium line 10 communicates via the third pressure medium line 9 with the pressure medium pump 12. In addition, the fourth pressure medium line 10 communicates with the control chamber 35 of the pressure accumulator 3 and with the secondary inflow port D. During operation of the internal combustion engine, pressure medium from the pressure medium pump 12 is conveyed via the third and fourth pressure medium lines 9, 10 to the control chamber 35. At the same time, pressure medium from the pressure medium pump 12 is conveyed via the third pressure medium line 9 to the inflow port P of the control valve 4, and via the third and fifth pressure medium lines 9, 11 to the storage chamber 15. As a result of the charging of the storage chamber 15 and the control chamber 35 with pressure medium, the piston 14 is displaced against the force of a spring and the pressure accumulator 3 is filled. When the operating pressure made available by the pressure medium pump 12 falls, a nonreturn valve 17 prevents pressure medium from flowing back from the control chamber 35 into the third pressure medium line 9. The piston 14 is therefore held in its position, whereby the pressure medium is retained in the storage chamber 15. For further details of the pressure accumulator 3, reference is made to DE 10 2007 056 684 A1.

The control valve 4 differs from the control valve 4 of the first embodiment in that the secondary inflow port D cannot be connected to the working ports A, B, but is connectable to an outflow port T. The control valve 4 again has five control positions S1-S5, the second to fourth control positions S2-S4 being identical to the respective second to fourth control positions S2-S4 of the control valve 4 of the first embodiment. The first and fifth control positions S1, S5 differ from the first and fifth control positions S1, S5 of the first embodiment in that the secondary inflow port is connected to the outflow port T. In these control positions S1, S5 the control chamber 35 of the pressure accumulator 3 is connected via the fourth pressure medium line 10 and the secondary inflow port D via the control valve 4 to the tank 13. Pressure medium can therefore be conveyed from the storage chamber 15 to the third pressure medium line 9 and supplied to the first or second pressure chamber 5, 6, depending on the control position S1, S5 of the control valve 4.

In this embodiment, too, therefore, both the regulation of the phase adjustment device 2 and the connecting of the pressure accumulator 3 can be effected by means of a single control valve 4.

REFERENCE SYMBOLS

1 Device
2 Phase adjustment device
3 Pressure accumulator
4 Control valve
5 First pressure chamber
6 Second pressure chamber
7 First pressure medium line
8 Second pressure medium line
9 Third pressure medium line
10 Fourth pressure medium line
11 Fifth pressure medium line
12 Pressure medium pump
13 Tank
14 Piston
15 Storage chamber
16 Nonreturn valve
17 Nonreturn valve
18 Hydraulic section
19 Actuating unit
20 Valve housing
21 Control piston
22 First housing opening
23 Second housing opening
24 Third housing opening
25 Fourth housing opening

26 Fifth housing opening
27 First annular groove
28 Second annular groove
29 Third annular groove
30 Fourth annular groove
31 First piston opening
32 Second piston opening
33 Third piston opening
34 Spring element
35 Control chamber
S1 First control position
S2 Second control position
S3 Third control position
S4 Fourth control position
S5 Fifth control position
A First working port
B Second working port
D Secondary inflow port
P Inflow port
T Outflow port

The invention claimed is:

1. A device for variably adjusting timing control of gas exchange valves of an internal combustion engine, comprising:

a hydraulic phase adjustment device; a control valve; and an auxiliary pressure source, the phase adjustment device being drivingly connected to a crankshaft and a camshaft, and the phase adjustment device having at least two counter-working pressure chambers, and a phase relation of the camshaft relative to the crankshaft being variably adjustable by charging of the pressure chambers with pressure medium, the control valve having at least one inflow port and a first working port and a second working port, the inflow port being connectable to a pressure medium pump, and the first working port being connectable to the first pressure chamber and the second working port being connectable to the second pressure chamber, wherein the control valve has a secondary inflow port which is connectable to the auxiliary pressure source, and the control valve can be moved to a first control position in which both the pressure medium pump and the auxiliary pressure source are connected to the first pressure chamber.

2. The device of claim 1, wherein the control valve can be moved to a second control position in which the pressure medium pump is connected to the first pressure chamber and a pressure medium volume flow from the auxiliary pressure source to the phase adjustment device is blocked.

3. The device of claim 2, wherein the control valve can be moved to a third control position in which a pressure medium volume flow to the pressure chambers is blocked or is equal and a pressure medium volume flow from the auxiliary pressure source to the phase adjustment device is blocked, in that the control valve can be moved to a fourth control position in which the pressure medium pump is connected to the second pressure chamber and a pressure medium volume flow from the auxiliary pressure source to the phase adjustment device is blocked, and in that the control valve can be moved to a fifth control position in which both the pressure medium pump and the auxiliary pressure source are connected to the second pressure chamber.

4. The device of claim 3, wherein the secondary inflow port communicates with the first working port or the second working port in the first control position or a fifth control position.

5. The device of claim 4, wherein the control valve has a hollow valve housing and a hollow control piston arranged therein, which control piston is displaceable between two end positions, and both the inflow port and the secondary inflow port and one of the first working port and the second working port communicate with an interior of the control piston in the first control piston or the fifth control position.

6. The device of claim 2, wherein the secondary inflow port communicates with the first working port or the second working port in the first control position or a fifth control position.

7. The device of claim 6, wherein the control valve has a hollow valve housing and a hollow control piston arranged therein, which control piston is displaceable between two end positions, and both the inflow port and the secondary inflow port and one of the first working port and the second working port communicate with an interior of the control piston in the first control piston or the fifth control position.

8. The device of claim 1, wherein the secondary inflow port communicates with an outflow port embodied on the control valve in the first control position or the fifth control position.

9. The device of claim 1, wherein the auxiliary pressure source is a pressure accumulator with a storage chamber, and the secondary inflow port is connected to the storage chamber of the pressure accumulator.

10. The device of claim 1, wherein the auxiliary pressure source is a pressure accumulator with a storage chamber and a control chamber, and the secondary inflow port is connected to the control chamber of the pressure accumulator and the inflow port is additionally connected to the storage chamber.

* * * * *